United States Patent [19]

Laboy

[11] 4,089,292

[45] May 16, 1978

[54] MECHANICAL SHOPPERS GUIDE

[76] Inventor: Amaury Antonio Laboy, 4145 Wilder Ave., Bronx, N.Y. 10466

[21] Appl. No.: 708,684

[22] Filed: Jul. 26, 1976

[51] Int. Cl.[2] ..... G09F 9/00

[52] U.S. Cl. ..... 116/133

[58] Field of Search ..... 116/132 R, 132 A, 131, 116/130, 133

[56] References Cited

U.S. PATENT DOCUMENTS

| | | | |
|---|---|---|---|
| 773,749 | 11/1904 | Kaplan | 116/133 |
| 2,177,978 | 10/1939 | Darvie | 116/133 |
| 2,866,601 | 12/1958 | Naber | 116/133 |

*Primary Examiner*—S. Clement Swisher
*Assistant Examiner*—Denis E. Corr
*Attorney, Agent, or Firm*—Lester Horwitz

[57] ABSTRACT

The invention provided a reminder device including a series of longitudinally spaced indicator means mounted on a base member, and a series of correspondingly spaced indicia each indicator means being rotatable into a position to indicate whether an item represented by the associated indicia is needed to be purchased at the store.

1 Claim, 6 Drawing Figures

FIG. 1
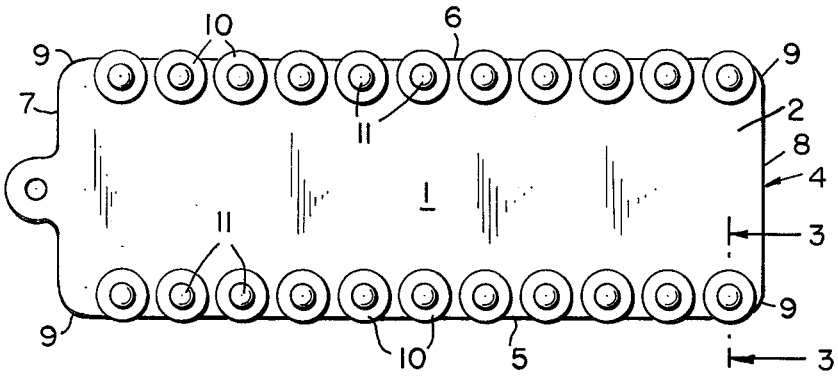
FIG. 3
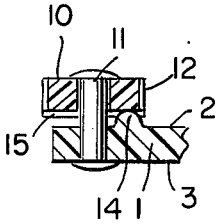
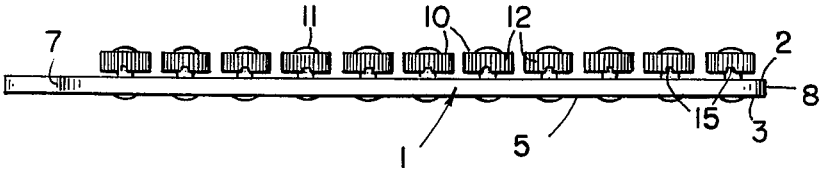
FIG. 2
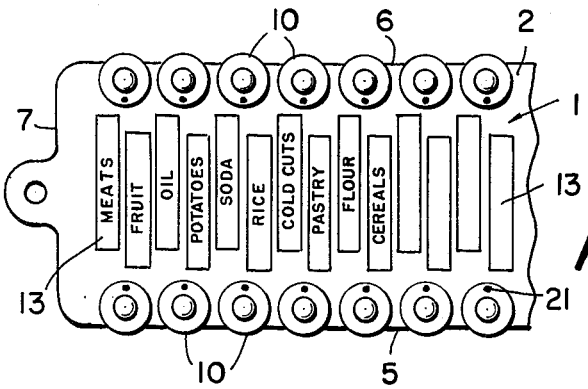
FIG. 4
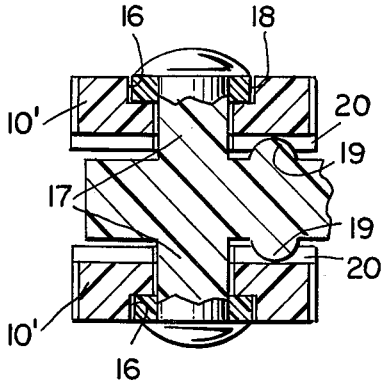
FIG. 6
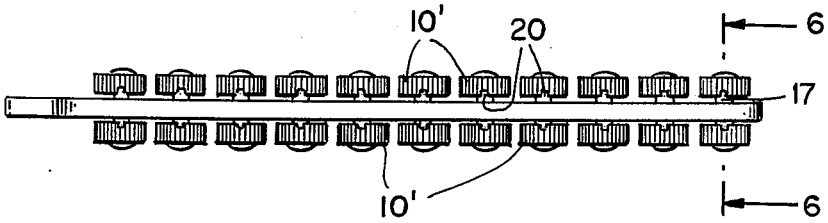
FIG. 5

MECHANICAL SHOPPERS GUIDE

BACKGROUND OF THE INVENTION

The present invention relates to a shoppers guide, and more particularly to a reminder device especially adapted for use by a shopper to keep track of what items are needed to be purchased at the store.

DESCRIPTION OF THE PRIOR ART

Most shoppers who market regularly buy the same items periodically. However, the conventional way of remembering what items are needed at a particular time is to make a list which is discarded after its use. It would seem that it would be helpful to have a device which could be used repeatedly to mechanically keep track of what items are needed to be purchased at the store.

SUMMARY OF THE INVENTION

The present invention is a reminder device comprising a base member, a plurality of spaced apart indicator means mounted on the base member, and a corresponding plurality of indicia on the surface of the base member, each said indicator means being positionable relative to an associated indicia to show a specific condition thereof.

The invention will be described in greater detail with reference to the attached drawings.

FIG. 1 is a plan view of the present invention.

FIG. 2 is a side view of one embodiment of the invention.

FIG. 3 is a cross-sectional view taken along line 1—1 of FIG. 1 for said one embodiment.

FIG. 4 is a plan view of the invention showing any typical arrangement of indicia.

FIG. 5 is a side view of another embodiment of the invention.

FIG. 6 is a cross-sectional view taken along line 1—1 of FIG. 1 for said other embodiment.

DESCRIPTION

Referring to FIG. 1 of the drawings, the device comprises a rectangularly shaped flat base member 1 of hard plastic material which is relatively thin. The base member 1 has a top surface 2 and bottom surface 3 and thin edge portions 4. The two longer sides 5,6 and two shorter ends 7,8 of the base member are joined at corners 9 which may be rounded as shown. Preferably, the base member is a single piece. Most preferably the base member is a solid molded piece. In one embodiment, a plurality of indicator means 10 are provided are rotatably mounted on one surface of the base member by suitable connector means such as rivets 11. The indicator means 10 are spaced apart from each other in a predetermined array as shown in FIG. 1. The connector means 11 extend through each indicator means 10 and the base member in such a manner as to permit rotation of the indicator means relative to the base member (See FIG. 2). Series of spaced indicator means are located so that a portion thereof extends beyond the edge of the associated long side of the base member. The connector means 11 illustrated in FIG. 2 are rivets having their head portion on the exposed surface of each indicator means and the other end of each rivet is upset to contact the undersurface of the base member, that is the surface opposite the surface upon which the indicator means are mounted. It is clear however, that any other conventional connector means could be used to mount the indicator means on the base member which would permit the required relative rotary movement of the indicator means thereon.

Each indicator means is preferably provided with a knurled edge 12 to facilitate rotation manually of the indicator means by digital pressure on the peripheral portion thereof extending outwardly from the long side of the base member.

There is provided on the top surface of the base member between the opposed arrays of indicator means a longitudinally arranged series of indicia 13 denoting specific articles. In the preferred embodiment of the invention, each indicia is the name of a produce or item obtainable at a store. The indicia may comprise a changeable label attached to the surface of the base member. Alternatively, the indicia may be etched or embossed regions on the surface of the base member with the name of the desired item indicated in each such region. Each label or region of indicia may be color coded to denote a specific item. Further, the indicia may comprise a blank area being adapted to have inscribed thereon a store item by the user.

There are an equal number of labels or indicia regions and indicator means and the indicator means are preferably arranged so that each indicator is associated with a specific label or indicia region. There may be provided a like color coding on each indicator means related to the color coding for the label or indicia region.

In addition, each indicator means is provided with a yes-no or go no-go type visual indication, 21. This indication may be in the form of a red and green are on the exposed surface of each indicator means or may be any suitable formation of dots or letters having a known meaning to enable the user to rotate the indicator means to signify a desired condition for its associated labeled item. In this manner, the indicator means could be used to denote that a particular item is needed to be purchased at the store by rotating the indicator means to align the positive symbol, that is a green area or a green dot with its associated labeled item. When that item is obtained at the store the particular indicator means is rotated to align the negative symbol, such as a red area or red dot, with the associated label or indicia region. The positive symbol could likewise take the form of a dot or arrow on the surface of the indicator, whereupon the absence of a dot or arrow on the remaining area of the indicator means would be the negative symbol.

A projection 14 is preferably provided on the surface of the base member 1 which abuts the indicator means. A series of grooves 15 may be formed in the indicator means 10 at such locations so that the projections on the base member would be releasably pressed into the grooves under pressure of the connector means. In this way a stop means is provided to hold the indicator means in a desired rotational position on the base member to maintain a positive or negative symbol in position relative to its associated label or indicia area.

A typical array of labels is shown in FIG. 4. The device may be used by a shopper to form a shopping list at home in preparation for a trip to the store. As each item needed at the store is noted, the indicator means for that item is rotated by digital pressure on its exposed knurled edge to align the positive symbol such as the green area or dot with the associated indicia for that item. When this operation is completed, there will then be a number of indicator means showing positive symbols in alignment with associated labels comprising a complete shopping list or guide for purchase at the store. Later, when the user is shopping as each item is obtained at the store the appropriate indicator means is rotated to align the negative symbol with its associated label to denote that such item is no longer needed. Obviously, this will be continued until all the indicator means are negative.

In another embodiment of the invention, as illustrated in FIG. 5, a plurality of indicator means 10' are provided and are rotatably mounted on both surfaces of the base member. The indicator means on each surface are spaced apart in a predetermined array and may be in register with the indicator means on the other surface of the base member as illustrated in FIG. 6. The rotatable mounting means for the indicator means in this embodiment may be provided by a rod 17 of the thermoplastic material which is positioned for assembly of the device through a central aperture in the indicator means on both surfaces of the base member and through an opening in the base member in register with the aforesaid apertures. The rod extends slightly above the exposed surface of each of the opposed indicator means. A recess 16 is provided in the outer surface of each indicator means surrounding the central aperture and coaxial therewith. A plastic washer 18 is then placed over the rod and positioned in the recess in each indicator means. The final assembly is made by heating the ends of the rod and pressing the plastic material to form a head portion in contact with the washer.

Of course, the plastic rod could be formed integrally with or separate from the base member. In FIG. 6 there is illustrated a base member having opposed projections 17 which form the rod to rotatably connect the indicator means on each surface of the base member. It will also be seen that a stop means 19 may be provided for each indicator means 10'. A projection 19 is provided on each surface of the base member for contact with a groove 20 on the inner surface of each of the opposed indicator means 10'.

I claim:

1. A reminder device comprising a base member, a plurality of spaced discs rotatably mounted on the base member and spaced longitudinally along two edges of the base member with a minor portion of each disc extending beyond the edge of said base member, a plurality of indicia on the surface of the base member spaced longitudinally along the base member and with each being aligned transversely with one of said discs, the indicia on the surface of the base member being a label designating an item obtainable at a store, said discs being provided with positive and negative indication symbols which are movable into alignment with the label to denote whether the item is needed or has already been obtained and which lie on surfaces of said discs which are completely exposed to view, a groove and projection being provided on the discs and base member for interengagement to provide a predetermined position of the discs relative to the associated indicia upon rotating movement of said discs to thereby indicate one of said positive and negative condition relating to such indicia.

* * * * *